United States Patent [19]

Jones

[11] Patent Number: 4,719,979

[45] Date of Patent: Jan. 19, 1988

[54] EXPENDABLE DIAMOND DRAG BIT

[75] Inventor: Kenneth W. Jones, Kingwood, Tex.

[73] Assignee: Smith International, Inc., Newport Beach, Calif.

[21] Appl. No.: 843,049

[22] Filed: Mar. 24, 1986

[51] Int. Cl.[4] ..... E21B 10/46; E21B 10/60

[52] U.S. Cl. ..... 175/329; 175/339; 175/379; 175/410

[58] Field of Search ..... 175/329, 334, 339, 340, 175/379, 410

[56] References Cited

U.S. PATENT DOCUMENTS

| | | | |
|---|---|---|---|
| 3,768,581 | 10/1973 | Rederon | 175/329 |
| 3,938,599 | 2/1976 | Horn | 175/329 |
| 4,221,270 | 9/1980 | Vezirian | 175/329 |
| 4,234,048 | 11/1980 | Rowley | 175/329 |
| 4,246,977 | 1/1981 | Allen | 175/329 |
| 4,253,533 | 3/1981 | Baker, III | 175/329 |
| 4,265,324 | 5/1981 | Morris et al. | 175/329 |
| 4,303,136 | 12/1981 | Ball | 175/329 |
| 4,325,439 | 4/1982 | Vezirian | 175/329 |
| 4,334,585 | 6/1982 | Upton | 175/329 |
| 4,350,215 | 9/1982 | Radtke | 175/329 |
| 4,440,247 | 4/1984 | Sartor | 175/393 |
| 4,475,606 | 10/1984 | Crow | 175/410 |
| 4,494,618 | 1/1985 | Radtke | 175/393 |
| 4,499,958 | 2/1985 | Radtke et al. | 175/329 |
| 4,505,342 | 3/1985 | Barr et al. | 175/329 |
| 4,533,004 | 8/1985 | Ecer | 175/329 |
| 4,538,690 | 9/1985 | Short, Jr. | 175/329 |
| 4,538,691 | 9/1985 | Dennis | 175/393 |
| 4,539,018 | 9/1985 | Whanger et al. | 51/295 |

OTHER PUBLICATIONS

"Rock-Bit Design, Selection and Evaluation", by H. G. Bentson, Smith Tool, Div. of Smith International, Inc., revised reprint of presentation at spring meeting of Pacific Coast District, API Division of Production, Los Angeles, May, 1956, printed in Aug., 1966.

*Primary Examiner*—George A. Suchfield
*Attorney, Agent, or Firm*—Robert G. Upton

[57] ABSTRACT

Drag-type drilling bits are disclosed which have at least one blade and a plurality of fluid flow channels incorporated in the blade for conducting drilling fluid or drilling mud from the hollow interior of the bit to discharge or ejection ports located in the front cutting edge of the blade. Rods of diamonds or of like "hard" cutter insert materials are incorporated in the blade in such a configuration that as the blade wears away or erodes and small pieces of diamonds are lost during drilling, more diamonds are exposed to the formation for drilling. During erosion or wear of the blades, the fluid discharge ports continue to operate to eject drilling fluid adjacent to substantially each diamond rod, whereby the flushing away of cuttings and cooling of the diamonds is greatly improved. In some embodiments of the invention rods of alternating hard and soft materials are also disposed substantially parallel with the diamond or like "hard" cutter insert rods. When the soft material of the rods is exposed for drilling the formation, kerfs are formed which are thereafter "chipped away" by the subsequently exposed hard material of the rods.

16 Claims, 12 Drawing Figures

3
48
46
40
36
38
30
20
22
24

46
48
36
40

4
48
46
44
50
40
36
38
30
32
34

52
50
5

36
52

EXPENDABLE DIAMOND DRAG BIT

BACKGROUND OF THE INVENTION

1. Field of the Invention

The present invention is directed to drag bits having diamond or other hard cutter inserts. More particularly, the present invention is directed to blade-type drag bits incorporating diamond cutter inserts wherein, even though the blades erode during drilling in a formation, the diamond inserts nevertheless remain effective for attacking the formation.

2. Brief Description of the Prior Art

Drilling bits or rock bits are well known in the art. Such drilling bits are used for drilling in subterranean formations when prospecting for oil or minerals. The term "drag bit", generally speaking, designates a drilling bit which has no rotating cones and which is rotated either from surface through a string of drill pipes and drill collars (drill string) or by a suitable "downhole" motor. In contrast, rotary cone or "roller" bits have several journals each of which carries a freely rotatable drill bit cone. Regardless whether rotary cone or drag bits are used for drilling in a formation, drilling fluid or "drilling mud" is continuously circulated from the surface through the drill string down to the drilling bit, and up to the surface again. As is well known, the circulating drilling mud serves several important functions; these include continuous cooling of the drill bit and removal of the cuttings which are generated by the drilling action.

Several types of drag bits are known in the art; these include fishtail bits, auger bits, as well as more "conventional" drag bits which lack relatively large extending blades but nevertheless may be provided with "hard" diamond, tungsten-carbide, or the like cutter inserts. Blade-type rotary drag bits are also known in the art which have diamond or other "hard" cutter inserts imbedded or affixed to the blades. Such blade-type bits are described, for example, in U.S. Pat. Nos. 4,440,247 and 4,499,958.

Generally speaking, one serious problem encountered in the prior art in connection with diamond or like "hard" insert studded drag bits is overheating of the diamond inserts due to inadequate flushing and cooling action of the drilling fluid. As is known, heat, unless dissipated through adequate cooling with drilling fluid, may convert the diamond of the inserts into graphite with a resulting loss of hardness and drilling power. Another serious problem encountered in connection with diamond studded drag bits involves loss of the diamond cutters from the bit. Yet another problem, which is especially serious in the field of blade-type bits is the relatively rapid wear or erosion of the blades of the bit. The erosion, of course, can also rapidly lead to loss of diamonds or like hard inserts from the blades.

Generally speaking, the prior art has attempted to solve the foregoing problems by providing drilling fluid outlet passages or holes adjacent to the diamond or like inserts in the drag bits, and by appropriately choosing the configuration of the drag bit body so as to optimize the flushing and cooling action of the drilling fluid on the cutter inserts. The drill bits described in U.S. Pat. Nos. 4,334,585, 4,325,439, 4,303,136, 4,253,533 4,246,977, 4,234,048, 4,221,270, 4,505,342, and 4,533,004 provide examples of these efforts in the prior art.

Still further descriptions of drilling bits, which comprise a general background to the present invention, may be found in U.S. Pat. Nos. 4,539,018, 4,538,691, 4,538,690, 3,768,581, 3,938,599, 4,265,324, 4,350,215, 4,475,606, and 4,494,618. A general overview of "Rock-Bit Design, Selection, and Evaluation" may be found in a paper bearing the above title. This paper is a revised reprint of a presentation made by H. G. Bentson at the spring meeting of the Pacific Coast District, API Division of Production, Los Angeles, May, 1956, printed in August, 1966.

In summary, the foregoing patent disclosures provide evidence of intense efforts in the prior art to develop rock bits in general, and diamond or like "hard" cutter insert studded drag bits in particular, which have prolonged working lives and improved wear characteristics. In spite of the foregoing efforts, there is definitely still need and room for improvement in this field. Specifically, there is need in the art for blade-type drag bits having diamond or like "hard" inserts, which are retained for operation in the blade even as a major portion of the blade is eroded or worn away during drilling. The present invention provides such blade-type drag bits.

SUMMARY OF THE INVENTION

It is an object of the present invention to provide a blade-type drag bit which has improved operating life and wear characteristics.

It is another object of the present invention to provide a blade-type drag bit having diamond or like "hard" cutter inserts which are retained in the blades and continue to remain exposed for operative engagement with the formation to be drilled, even as the blade wears or erodes during drilling.

It is still another object of the present invention to provide a blade-type drag bit having diamond or like "hard" cutter inserts wherein flow of drilling fluid or drilling mud to the inserts is optimized.

It is yet another object of the present invention to provide a blade-type drag bit having diamond or like "hard" cutter inserts which, during drilling, causes kerfs to be formed in the formation from time-to-time, and which thereby facilitates drilling of the formation.

The foregoing objects or advantages are attained by a blade-type drilling bit which has a pin end adapted for being removably attached to a drill string, and a bit body attached to the pin end. The bit body has an interior cavity in fluid communication with the drill string to receive a supply of drilling fluid therefrom. At least one drilling blade is attached to the bit body. The blade has a leading edge configured to contact the formation during drilling. A plurality of channels or apertures in fluid communication with the interior cavity of the bit body are disposed in the blade. The channels terminate in fluid discharge ports on the leading edge of the blade. A plurality of cavities or apertures of a second kind are disposed in the blade and contain elongated rods of diamond or other "hard" drilling material. The elongated diamond rods are disposed in such a configuration that, as the blade erodes, and as small pieces of diamonds are lost during drilling, additional parts of the rods become exposed to the formation to effectively drill the same.

In an alternative embodiment of the invention, additional elongated rods having, along their respective longitudinal axes, alternate pieces of hard and soft materials, are also contained in the blade. During drilling, kerfs are formed in the formation when the soft materials are exposed for drilling. When the soft material erodes, the alternate layer of hard material is exposed to remove the kerfs.

The foregoing and other objects and advantages can be best understood, together with further objects and advantages, from the ensuing description taken together with the appended drawings wherein like numerals indicate like parts.

DESCRIPTION OF THE PREFERRED EMBODIMENTS

Figure 1:
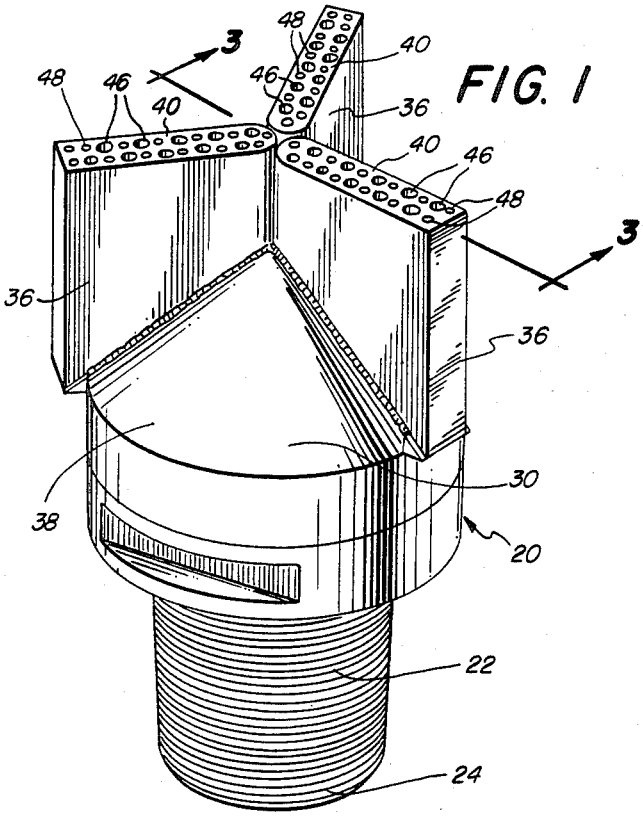
FIG. 1 is a perspective view of a first preferred embodiment of the blade-type drilling bit of the present invention.
Figure 2:
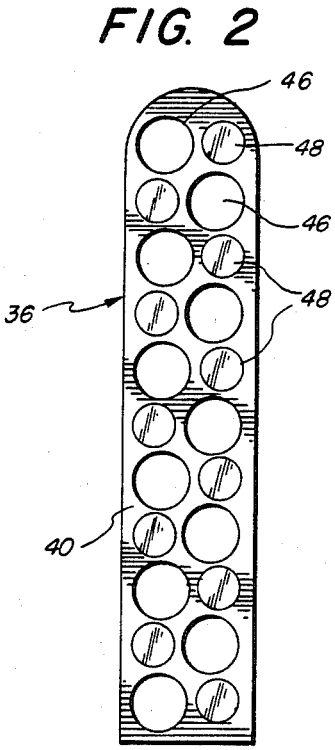
FIG. 2 is a plan view of a blade of the first preferred embodiment shown in FIG. 1.

The following specification taken in conjunction with the drawings sets forth the preferred embodiments of the present invention. The embodiments of the invention disclosed herein are the best modes contemplated by the inventor for carrying out his invention in a commercial environment, although it should be understood that several modifications can be accomplished within the scope of the present invention.

It should be noted at the outset of the present description that the novel blade-type drilling bits of the present invention incorporate, in addition to the hereinafter-emphasized novel features, certain conventional features as well. Such conventional features, which are well known to those skilled in the art, are described here only to the extent necessary to explain and illuminate the novel features of the drilling bits of the invention.

Referring now to FIGS. 1 through 5 and 8 of the appended drawings, a fishtail bit comprising the first preferred embodiment 20 of the blade-type drilling bit of the present invention is disclosed. The blade-type drilling bit 20 includes a pin portion 22 which has a threaded end 24 wherethrough the drilling bit 20 is attached to a drill string. A lower portion 26 of the drill string is shown on FIG. 8. The pin portion 22 has a second threaded end 28, the male threads of which are attached to a generally conically-shaped bit body 30. The bit body 30 is hollow so that its interior cavity 32 is in fluid communication, through the hollow pin portion 22, with the drill string 26. Consequently, the interior cavity 32 receives a pressurized supply of drilling fluid or drilling mud from the surface (not shown) from where, in accordance with standard practice in the art, the drilling mud is continuously pumped down to the drilling bit 20. The drilling fluid or drilling mud is not shown in the appended drawings, although its direction of flow through the first preferred embodiment 20 of the drilling bit of the present invention is indicated by arrows 34 on FIG. 3.

A principal novel feature of the present invention is in the construction of the blades 36 which are affixed by welding (or other suitable means) to the bit body 30. In the fishtail bit of the herein-described first preferred embodiment 20 there are three blades 36 placed at a 120-degree angle relative to one another. Each blade 36 is welded into a suitable slot (not specifically shown) provided on the conical surface 38 of the bit body 30. It should be understood, of course, that in alternative embodiments, less or more than three blades 36, constructed in accordance with the present invention, may be affixed to the bit body 30.

Figure 9:
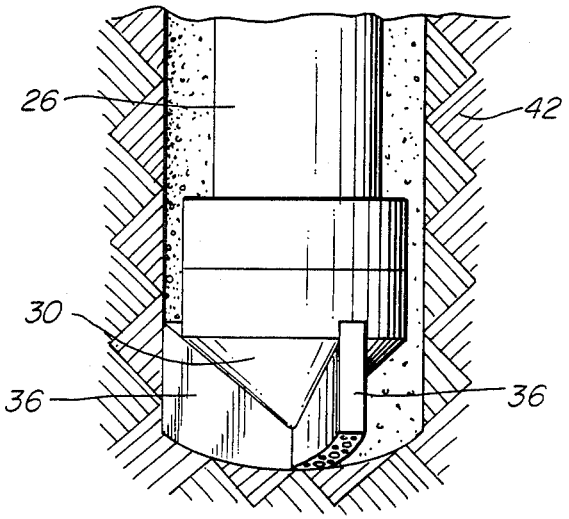
FIG. 9 is a schematic side view showing the first preferred embodiment of the blade-type drilling bit of the present invention in operation in a borehole.
Figure 10:
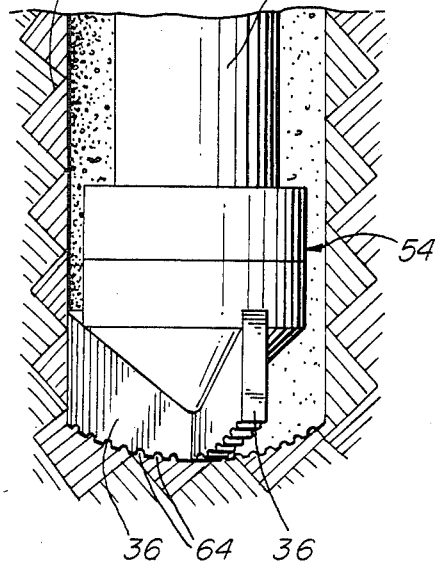
FIG. 10 is a schematic side view showing the second preferred embodiment of the blade-type drilling bit of the present invention in operation in a borehole.

Each blade 36 includes a leading edge 40 which is configured to come into contact with the formation 42 during drilling. The formation 42 is schematically shown in FIGS. 9 and 10. A plurality of substantially evenly spaced channels or apertures 44 penetrate through the body of the blade 36, with the longitudinal axes of the channels 44 being substantially at right angles to the front cutting or leading edge 40 of the blade 36. The apertures or channels 44 are in fluid communication with the interior cavity 32 of the bit body 30. This is best shown on the cross-sectional view of FIG. 3. At the leading edge 40 of the blade 36 the channels 44 terminate in discharge or ejection ports 46. It should be apparent from the foregoing that during the drilling process, drilling fluid or drilling mud is ejected from each of the discharge ports 46.

Figure 3:
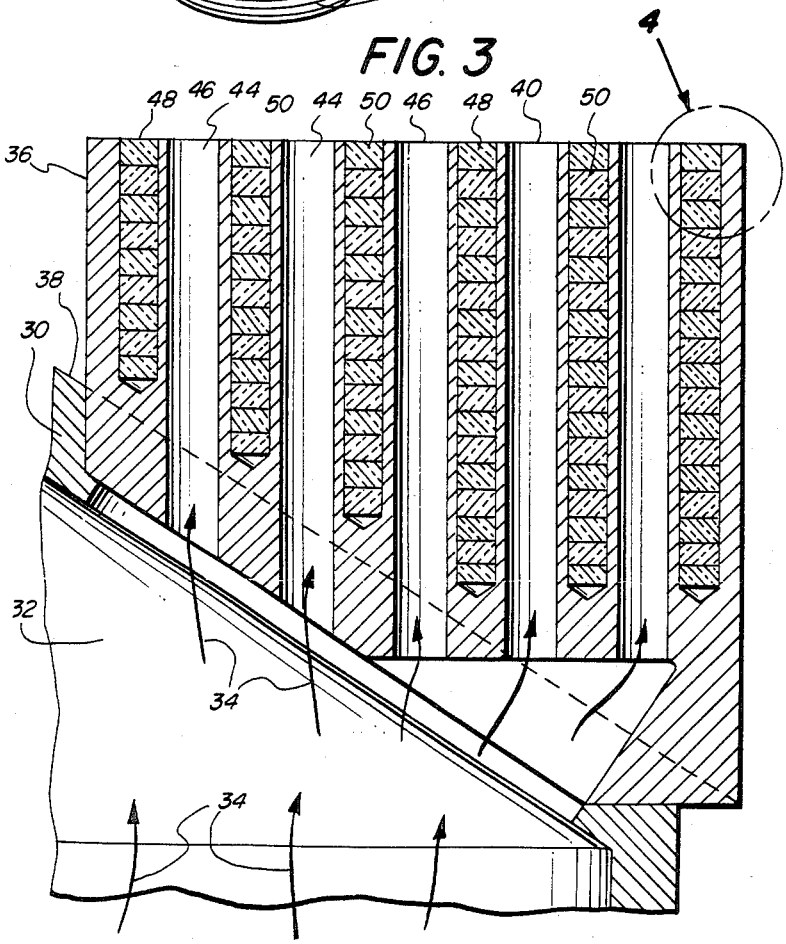
FIG. 3 is a partial cross-sectional view taken on lines 3,3 of FIG. 1.

Referring still principally to FIG. 3, a second set of substantially evenly spaced apertures or holes 48 in the body of the blades 36 is shown, disposed substantially parallel with the apertures or channels 44 for the drilling fluid. The second set of holes 48 are, however, "blind" in that they terminate somewhat above the line where the blade 36 is attached to the conical surface 38 of the bit body 30. On the plan view of FIG. 2 the apertures or holes 48 of the second set are shown as the smaller diameter holes, relative to the larger diameter discharge ports 46 for the drilling fluid. In the herein-described preferred embodiment the diameter of the discharge ports 46 is approximately $\frac{3}{4}''$, whereas the diameter of the blind holes 48 is approximately 0.5". It should, of course, be understood that the diameter of the discharge ports 46 and of the holes 48 are design features which may be varied without departing from the spirit of the invention.

Figure 4:
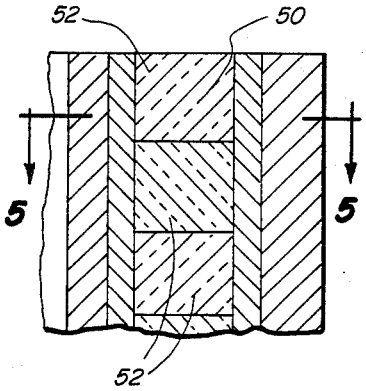
FIG. 4 is an enlarged partial view of the area designated in FIG. 3.
Figure 5:
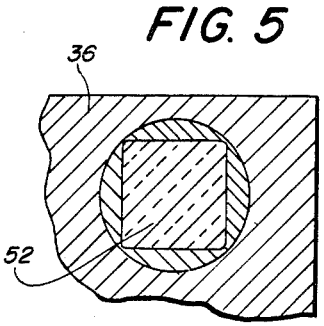
FIG. 5 is a cross-sectional view taken on lines 5,5 of FIG. 4.

In accordance with the present invention a rod of "hard" cutter insert material is affixed in each of the apertures or holes 48, as is best shown on FIGS. 3, 4, and 5. The best suited "hard" material for this purpose is diamond, although other materials, such as cubic boron nitride, and even tungsten-carbide in a suitable metal matrix, may also be used. Because the preferred embodiments of the present invention utilize diamond inserts, and because primarily diamonds are contemplated to be used as the hard cutter inserts in connection with the present invention, the ensuing description principally refers to the cutter inserts as "diamonds". Nevertheless, it should be kept in mind that other "hard" cutter insert materials, which, per se, are known in the art, may also be used in connection with the present invention.

Still more particularly, the diamond insert rods 50, which are incorporated in the drilling bits of the present invention, may comprise natural, synthetic, or composite diamonds. Composite diamonds are synthetic diamonds in a suitable metal matrix formed into practically any desired shape. In the herein-described preferred embodiments synthetic, polycrystalline diamonds are used, which are commercially available in the United States from several sources, including the General Electric Company, and from Megadiamond, a Division of Smith International, Inc. As is known by those skilled in the art, synthetic polycrystalline diamonds can also be formed into practically any desired shape, such as rods, cubes, cylinders, and the like. For example, cubes of synthetic polycrystalline diamonds are available from the General Electric Company under the GEOSET trademark.

Referring still primarily to FIGS. 3, 4, and 5, the diamond rods 50 of the herein-described first preferred embodiment 20 are shown to be built from a plurality of synthetic polycrystalline diamond cubes 52. These may be simply placed, in a stacked fashion as shown, into the blind holes 48. Thereafter the remaining space in the holes 48 is filled with a suitable tungsten-carbide powder, and the diamond cubes 52 are affixed together with the powder in the holes 48 with a suitable copper-nickel or like brazing alloy. Alternative modes of affixing diamonds of various configuration in the holes 48 include placing diamonds into a tungsten-carbide matrix and thereafter brazing the assembly into the holes 48. Inasmuch as affixing diamonds into holes or cavities of drilling tools and the like is known technology, still other methods of affixing the diamonds, or forming diamond rods, in the holes 48 of the drilling bit 20 of the present invention may become readily apparent to those skilled in the art.

To complete the description of the drilling bit 20 it is noted that the blades 36 comprise grade 4130 or like steel, which is commonly used in the art for the construction of fishtail bits. Moreover, the sides of the blades 36 may be carburized or otherwise hardened so as to prevent such erosion on the sides which may result in "breakthrough" to the drilling fluid flow channels 44.

Figure 8:
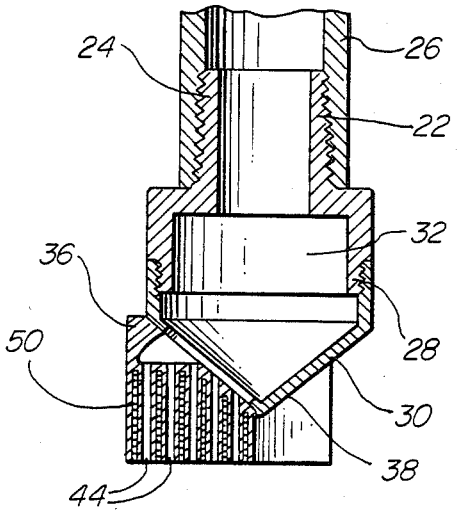
FIG. 8 is a cross-sectional view of the first preferred embodiment assembled to a drill string.

FIG. 8 shows the first preferred embodiment 20 of the drilling bit of the present invention assembled to the lower end 26 of the drill string.

FIG. 9 schematically illustrates the first preferred embodiment 20 of the drilling bit in operation. As is well known, the conventional steel blades of fishtail bits wear away or erode relatively rapidly, and the rate of erosion relative to the center of the blades 36 increases with the square of the distance from the center. Stated in other words, the blade erodes significantly faster radially outwardly from the center of the blade than in the center. As the fishtail drilling bit is operated for many hours, it is not uncommon for several inches to be lost from the blade, particularly on the radially remote portions, whereby the blade attains the configuration schematically shown on FIG. 9. The actual rate of erosion, of course, depends greatly on the nature of the formation being drilled. In conventional diamond studded fishtail bits significant erosion or wear normally results in loss of the diamonds from the leading cutting edge of the blades, and seriously impairs the ability of the bit to function. In the drilling bit 20 of the present invention, however, as the blades 36 wear away and as small pieces of the diamond rods 50 break off or wear off, successive portions of the embedded diamond rods 50 become exposed for drilling the formation 42. Thus, the fishtail bit 20 of the present invention has very significantly increased useful life compared to prior art diamond studded fishtail bits.

Moreover, in the fishtail bit 20 of the present invention each exposed diamond rod 50 is immediately adjacent to at least one discharge or ejection port 46 for the drilling fluid, whereby optimal flushing away of cuttings and cooling of the diamonds is attained. As the blades 36 and the diamond rods 50 erode, the relative configuration of the discharge ports 46 to the exposed diamond rods 50 does not change in the foregoing respect, so that the optimal flushing and cooling pattern is retained during the prolonged useful life of the drilling bit 20.

Figure 6:
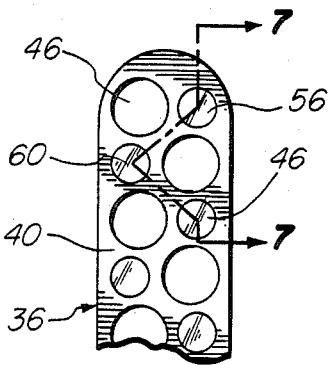
FIG. 6 is a partial top view of a blade of a second preferred embodiment of the blade-type drilling bit of the present invention.
Figure 7:
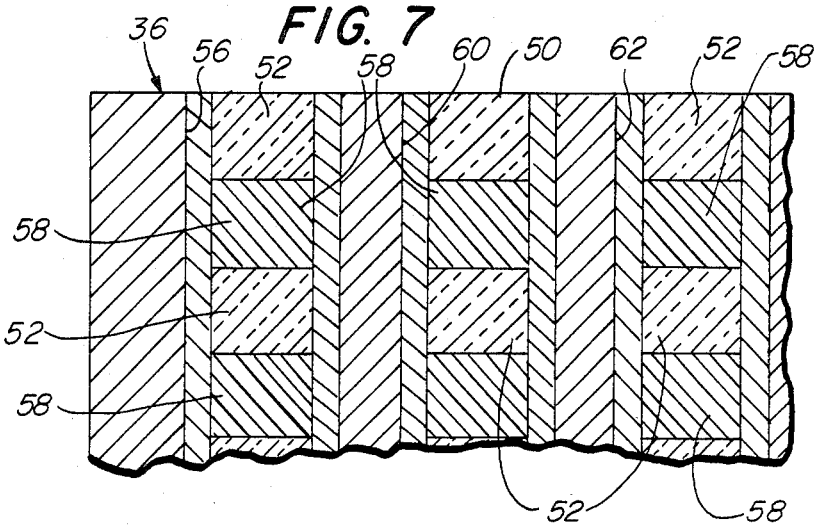
FIG. 7 is a partial cross-sectional view taken on lines 7,7 of FIG. 6.

Referring now to FIGS. 6, 7, and 10, a fishtail-type drilling bit comprising the second preferred embodiment 54 of the present invention is disclosed. The construction of the second preferred embodiment 54 is similar in many respects to the construction of the first preferred embodiment 20, except that, alternately, diamond rods 50 and alternating hard and soft materials are placed into the blind holes, which, in the first preferred embodiment, hold the diamond rods 50 only. This particular feature of the second preferred embodiment 54 is best shown on the cross-sectional view of FIG. 7.

More particularly, with reference to FIG. 7, a first blind hole 56 of the second preferred embodiment 54 contains alternately, relative to the longitudinal axis of the hole 48, pieces of hard material, preferably diamond cubes 52 of the type described in connection with the first embodiment 20, and steel cubes 58. As it is described in more detail below, the steel behaves during drilling as "soft" material. The alternating pieces of diamonds 52 and steel 58 may be affixed in the blind hole 56 in several ways known in the art. For example, and advantageously, the alternating pieces of diamond and steel may be embedded in a tungsten-carbide matrix and thereafter brazed into the hole 56.

A second and adjacent blind hole 60 contains a diamond rod 50 which may be affixed into the blind hole 48 in the same manner as in the above-described first preferred embodiment 20.

A third blind hole 62 again contains alternating pieces of hard diamond and soft steel material. This alternating structural arrangement is repeated preferably in the entire blade 36, or at least in a portion thereof.

Each blade 36 of the second preferred embodiment 54 also includes the channels 44 and discharge ports 46 for the drilling fluid adjacent to each blind hole containing, in this embodiment, either diamond rods 50 or alternating diamond 52 and steel 58 pieces.

The operation and advantages of the fishtail drilling bit comprising the second preferred embodiment 54 of the present invention is best explained with reference to FIG. 10. As the blades 36 of the bit 54 erode during drilling, the diamonds 52 and the "soft" steel pieces 58 become alternately exposed to contact the formation 42. FIG. 10 schematically illustrates operation of the drill bit 54 when the "soft" steel pieces 58 are exposed. In this condition, substantially concentric kerfs 64 are formed in the formation 42 in the areas where the soft pieces 58 are exposed. This is, of course, due to the fact that the soft steel 58 is much less efficient in drilling than the harder steel of the blades 36 and the still harder diamond rods 50. When the exposed soft piece 58 erodes or wears away in the drilling process, then a "hard" diamond piece 52 is exposed in its place. The hard diamond readily chips or grinds away the laterally unsupported kerf 64. Consequently the entire process of drilling is facilitated.

Figure 11:
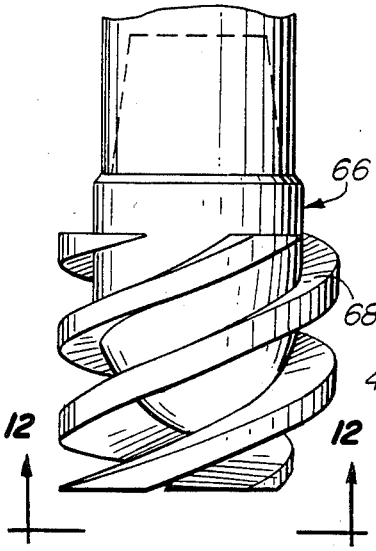
FIG. 11 is a schematic side view of a third preferred embodiment of the blade-type drilling bit of the present invention.
Figure 12:
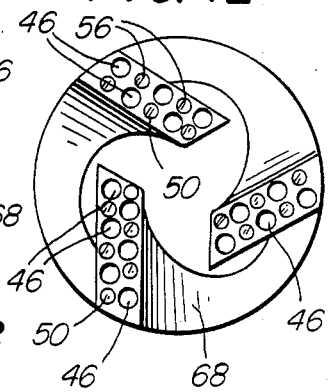
FIG. 12 is a bottom view of the third preferred embodiment.

Referring now to FIGS. 11 and 12, an auger-type drilling bit comprising the third preferred embodiment 66 of the present invention is disclosed. The generic principles disclosed in detail in connection with the first preferred embodiment 20 of the drilling bit of the present invention are also applied in the third preferred embodiment 66. Thus, in the third preferred embodiment 66, a plurality of channels 44 are provided in the blade 68 to communicate with the hollow interior (not shown) of the bit body 30. The channels 44 terminate in discharge ports 46 in the front leading or cutting edge 70 of the blade 68. As in the other previously described embodiments, drilling fluid or drilling mud is ejected from the discharge ports 46 during the drilling operation. Adjacent to each discharge port 46 a diamond rod 50 (or like "hard" material) is mounted in a hole 48 located in the blade 68. Consequently, as the blade 68 wears or erodes during drilling in the formation 42, and as small pieces of diamonds are broken off, additional diamonds become exposed to drill the formation. Moreover, as in the other previously described preferred embodiments, the drilling fluid is ejected from a discharge port 46 adjacent to each diamond rod 50, so that the flushing away of cuttings and cooling of the exposed diamond rods 50 is optimized. In light of the foregoing, the auger-type drilling bit 66 of the present invention also has a greatly prolonged useful life relative to prior art auger-type drilling bits.

Several modifications of the drilling bits of the present invention may become readily apparent to those skilled in the art in light of the present disclosure. Therefore, the scope of the present invention should be interpreted solely from the following claims, as such claims are read in light of the disclosure of the invention.

What is claimed is:

1. A drill bit for drilling in subterranean formations comprising:

a pin end formed at a first end of said drill bit adapted for being removably attached to a drill string;

a drill bit body attached to the pin end of said drill bit, the body forms an interior cavity which is in fluid communication with the drill string for receiving drilling fluid in the interior cavity; and two or more drilling blades attached to the drill bit body at a second cutting end of said drill bit, each drilling blade forms a leading edge configured for contacting the formation when the drill bit is used for drilling, the drilling blade forms a plurality of channels penetrating through the body of the blade and comprising means for conducting drilling fluid from the interior cavity of the drill bit body to the leading edge of the blade where each of the channels forms a fluid discharge port whereby, as the blade erodes during drilling, the drilling fluid continues to be ejected from the several discharge ports formed in the eroding leading edge of the blade, the drilling blade having a plurality of elongated rods comprising hard diamond drilling material, the rods being affixed to the blade in cavities formed in the blade and being exposed for drilling the formation in the leading edge of the blade with their respective longitudinal axes substantially perpendicular to the direction of erosion of the blade, whereby, as the blade and the rods of hard diamond drilling material erode during drilling, the rods continue to be exposed in the eroding leading edge of the blade, said drilling blades having approximately the same number of discharge ports as elongated rods comprising hard diamond material and wherein at least one fluid discharge port is located immediately adjacent to the exposed end of each diamond rod.

2. The drill bit of claim 1 wherein the elongated rods comprise synthetic polycrystalline diamonds.

3. The drill bit of claim 1 wherein the cavities disposed in the blade, wherein the elongated rods are affixed, are apertures incorporated in the body of the blade.

4. The drill bit of claim 1 configured as a fishtail-type bit comprising three blades.

5. A fishtail-type drill bit for drilling in subterranean formations comprising:

a hollow pin portion having a threaded first end formed by said drill bit for removable attachment to a drill string;

a drill bit body attached to the pin portion, said body forms an interior cavity which is in fluid communication, through the pin portion, with the drill string for receiving drilling fluid in the interior cavity;

a plurality of drilling blades attached to the drill bit body at a second cutting end of said drill bit, each of the driling blades forming a leading edge configured for contacting the formation, each of the drilling blades forms a plurality of apertures of a first kind penetrating through the body of the blade and comprising means for conducting drilling fluid from the interior cavity of the drill bit body to the leading edge of the blade where each of the apertures of the first kind forms a fluid discharge port, whereby, as the blades erode during drilling, the drilling fluid continues to be ejected from the several discharge ports in the eroding leading edge of each blade, eachof the drilling blades forms a plurality of apertures of a second kind disposed substantially parallel with the apertures of the first kind, the apertures of the first and second kind being substantially evenly spaced relative to one another so that substantially each aperture of the first kind is adjacent to at least one aperture of the second kind; and a plurlaity of elongated rods of a first kind comprising hard diamond drilling material, the rods being housed in the apertures of the second kind and being exposed for drilling the formation in the leading edge of the blades, whereby, as the blade and the rods of hard diamond drilling material erode during drilling, the rods continue to be exposed in the eroding leading edges of the blades, each blade additionally incorporates a plurality of elongaged rods of a second kind having, relative to their respective longitudinal axes, alternately spaced hard and soft materials, the rods of the second kind being disposed in apertures of the second kind substantially parallel relative to the rods of a first kind of hard material, whereby during drilling, when the soft material is exposed to the formation, kerfs are formed in the formation, and whereby the kerfs are eroded when the hard diamond material of the rods of the second kind aligned with and immediately adjacent to said soft material, is exposed to the formation.

6. The drill bit of claim 5 wherein the rods of hard material comprise synthetic polycrystalline diamonds.

7. The drill bit of claim 5 wherein the diamonds are disposed in a matrix which is brazed into the apertures of the second kind with a brazing alloy.

8. The drill bit of claim 5 having three blades.

9. The drill bit of claim 5 wherein the soft material of the rods of the second kind comprise steel.

10. The drill bit of claim 5 wherein the rods of the second kind are substantially evenly and alternately spaced with the rods of a first kind of hard diamond material.

11. The drill bit of claim 5 wherein the cavities disposed in the blades, wherein the elongated rods of the first and second kind are affixed, are apertures of a second kind included in the body of the blades.

12. An auger-type drill bit for drilling in subterranean formations comprising:

a pin end formed at a first end of the bit adapted for being removably attachable to a drill string;

a drill bit body attached to the pin end, said body forms an interior cavity which is in fluid communication with the drill string for receiving drilling fluid in the interior cavity;

at least one spirally oriented drilling blade attached to the drill bit body at a second cutting end of said drill bit, said blade forms a leading edge configured for contacting the formation when the drill bit is used for drilling, the spirally oriented drilling blade further forms a plurality of channels penetrating through the blade and comprising means for conducting drilling fluid from the interior cavity of the drill bit body to the leading edge of the blade where each of the channels forms a fluid discharge port whereby, as the blade erodes during drilling, the drilling fluid continues to be ejected from the several discharge ports in the eroding leading edge of the blade; and a plurality of elongated rods comprising hard diamond drilling material, the rods being affixed to the spirally oriented blade in cavities disposed in the blade and being exposed for drilling the formation in the leading edge of the blade with their respective longitudinal axes substantially at a right angle to the direction of erosion of the blade whereby, as the blade and the rods of hard diamond drilling material erode during drilling, the rods continue to be exposed in the eroding leading edge of the blade, the blade having approximately the same number of fluid discharge ports as elongated rods comprising hard diamond material, and wherein at least one fluid discharge port is located adjacent to the exposed end of each rod.

13. The drill bit of claim 12 wherein the elongated rods comprise synthetic plycrystalline diamonds.

14. The drill bit of claim 12 wherein the cavities disposed in the blades, wherein the elongated rods are affixed, are apertures included in the body of the blade.

15. A process of manufacturing a drill bit for drilling in subterranean formations, the process comprising the steps of:

forming a drill bit body having an interior cavity;

forming two or more drilling blades to be attachable to the drill body and forming a plurality of fluid flow channels penetrating through the body of the blade, said channels leading from the interior cavity of the drill body to a leading edge of the blades when the blade is attached to the bit body;

forming a plurality of cavities disposed in the blade with their respective longitudinal axes being substantially perpendicular to the direction of erosion of the blade during drilling; and affixing an elongated rod of hard diamond drilling material in each of the cavities, one of said plurality of flow channels being adjacent to one of said plurality of cavities, said channels and said cavities being substantially equal in number.

16. The process of claim 15 wherein the elongated rods comprise synthetic polycrystalline diamonds.

* * * * *